US008052482B1

(12) United States Patent
Lin

(10) Patent No.: US 8,052,482 B1
(45) Date of Patent: Nov. 8, 2011

(54) FEMALE ELECTRICAL CONNECTOR

(75) Inventor: Yen-Lin Lin, Luchou (TW)

(73) Assignee: Jyh Eng Technology Co., Ltd., Luchou, Taipei Hsien (TW)

( * ) Notice: Subject to any disclaimer, the term of this patent is extended or adjusted under 35 U.S.C. 154(b) by 0 days.

(21) Appl. No.: 12/913,958

(22) Filed: Oct. 28, 2010

(51) Int. Cl.
*H01R 24/00* (2011.01)

(52) U.S. Cl. ..... 439/676; 439/941

(58) Field of Classification Search ..... 439/676, 439/941, 670
See application file for complete search history.

(56) References Cited

U.S. PATENT DOCUMENTS

| | | | | |
|---|---|---|---|---|
| 4,556,264 | A * | 12/1985 | Tanaka | 439/62 |
| 6,749,466 | B1 | 6/2004 | Milner et al. | |
| 7,112,100 | B2 * | 9/2006 | Ishikawa et al. | 439/676 |
| 7,429,178 | B2 * | 9/2008 | Givens et al. | 439/79 |
| 7,985,102 | B2 * | 7/2011 | Bergner et al. | 439/676 |

* cited by examiner

*Primary Examiner* — Hae Moon Hyeon
(74) *Attorney, Agent, or Firm* — Guice Patents PLLC

(57) ABSTRACT

A female electrical connector includes an insulative housing, a rack mounted in the insulative housing and 8 pcs of gold pins arranged in the rack for signal transmission. The $1^{st}$, $3^{rd}$ and $5^{th}$ pins each have the respective top end extending obliquely backwardly from the front side of the rack and then curved and closely attached to the rear side of the rack so that the transmission direction of the $1^{st}$, $3^{rd}$ and $5^{th}$ pins is reversed to that of the $2^{nd}$, $4^{th}$, $6^{th}$, $7^{th}$ and $8^{th}$ pins, enabling the female electrical connector for signal transmission in the fully bandwidth range of 1~500 MHz.

7 Claims, 6 Drawing Sheets

FEMALE ELECTRICAL CONNECTOR

BACKGROUND OF THE INVENTION

1. Field of the Invention

The present invention relates to electrical connector technology and more particularly, to a female electrical connector, which has the $1^{st}$, $3^{rd}$ and $5^{th}$ gold pin thereof curved to reverse the transmission direction relative to the other gold pins.

2. Description of the Related Art

When connecting a computer or electronic equipment to a local-area network (LAN), for example, Ethernet, a registered jack-45 (RJ 45) connector is commonly used. A RJ 45 connector comprises an insulative housing, a rack mounted in the housing, and conductors, i.e., 8 pieces of gold pins carried in the rack. These gold pins extend smoothly upwardly into the inside of the insulative housing in a parallel manner for the contact of the contact pins of an inserted male electrical connector.

In the pair configuration of the transmission lines of an RJ 45 connector, there are four pairs of transmission lines wherein pair 1 consists of pin 5 and pin 4; pair 2 consists of pin 1 and pin 2; pair 3 consists of pin 3 and pin 6; pair 4 consists of pin 7 and pin 8. Further, crosstalk interference in RJ 45 connectors is defined as: coupling of signal energy from one signal transmission line to adjacent lines. This induced energy is called the crosstalk noise.

According to transmission line theory, a high crosstalk noise tends to be induced in parallel pins. Therefore, it is the common transmission method to transmit a negative signal and a positive signal through the two pins of one same pair at a same timing, and to avoid the change of having the pins of each pair to be in parallel to the pins of the other pairs.

In a conventional RJ 45 connector, there are 8 pces of pins arranged in parallel, and crosstalk interference tends to occur in the plug contact area. In pair combination, there are three combinations, i.e., pair 3 to pair 1; pair 3 to pair 2; pair 3 to pair 4. Because pin 3 and pin 6 of pair 3 are isolated by pin 4 and pin 5 of pair 1, pin 3 will cause the adjacent pin 4 and pin 2 to induce a crosstalk noise. In the same reason, pin 6 will cause the adjacent pin 5 and pin 7 to induce a crosstalk noise. Due to parallel line arrangement, noise energy will be rapidly accumulated subject to extent of the parallel distance.

Therefore, pin 3 and pin 5, or, pin 4 and pin 6 are commonly designed to have a different transmission direction or signal transmission channel, reducing the chance of parallelism and lowering the crosstalk noise level. However, this technique is simply applicable to 250 MHz or below. For application in the range of 250~500 MHz, this technique is less effective.

U.S. Pat. No. 6,749,466 discloses an electrical connector, entitled "Electrical connector contact configurations". This invention is adapted to improve signal transmission quality, enabling the bandwidth to be increased to 500 MHz. However, this design has a complicated structure that is not easy to fabricate. In consequence, the cost of this design is high. Therefore, an improvement is necessary.

SUMMARY OF THE INVENTION

The present invention has been accomplished under the circumstances in view. It is the main object of the present invention to provide a female electrical connector, which is practical for use with a male electrical connector for network signal transmission in the full bandwidth range of 1~500 MHz.

To achieve this and other objects of the present invention, a female electrical connector is adapted for use with a male electrical connector for network signal transmission, comprising an insulative housing a rack and 8 pcs of gold pins. The insulative housing comprises a front opening for the insertion of a matting male electrical connector. The rack is flat configured and mounted in a bottom side inside the insulative housing, having opposing front and rear sides and opposing top and bottom sides. The 8 pcs of gold pins are numbered from $1^{st}$ to $8^{th}$ and respectively arranged on the rack. Each gold pin has a top end extending to the top side of the rack and a bottom end vertically downwardly extending out of the bottom side of the rack. The top ends of the $2^{nd}$, $4^{th}$, $6^{th}$, $7^{th}$ and $8^{th}$ pins extend obliquely backwardly from the front side of the rack and suspend above the rear side of the rack. The top ends of said $1^{st}$, $3^{rd}$ and $5^{th}$ pins extend obliquely backwardly from the front side of the rack and are then curved and closely attached to the rear side of the rack so that the transmission direction of the $1^{st}$, $3^{rd}$ and $5^{th}$ pins is reversed to that of the $2^{nd}$, $4^{th}$, $6^{th}$, $7^{th}$ and $8^{th}$ pins. Further, the $1^{st}$, $3^{rd}$ and $5^{th}$ pins each have an arched middle part protruding over the elevation of a middle part of the top end of each of the $2^{nd}$, $4^{th}$, $6^{th}$, $7^{th}$ and $8^{th}$ pins that suspends above the rack, thereby constituting a plug contact area.

As the transmission direction of the $1^{st}$ pin of the female electrical connector is same as the $3^{rd}$ and $5^{th}$ pins, and can reduce crosstalk interference, smoothening signal transmission in the full bandwidth range of 1~500 MHz. Further, the whole structural design is simple, facilitating fabrication and installation.

Further, a metal shielding shell is provided to surround the insulative housing for protection.

Further, the metal shielding shell comprises a plurality of protruding clamping lugs bendable for fastening to the insulative housing.

Further, the rack comprises stop blocks and grooves to prohibit the gold pins from lateral displacement.

Further, the rack comprises a plurality of engagement blocks for fastening to the insulative housing.

Further, the rack comprises a plurality of bottom locating blocks for fastening to a circuit board.

DETAILED DESCRIPTION OF THE PREFERRED EMBODIMENT

Figure 1:
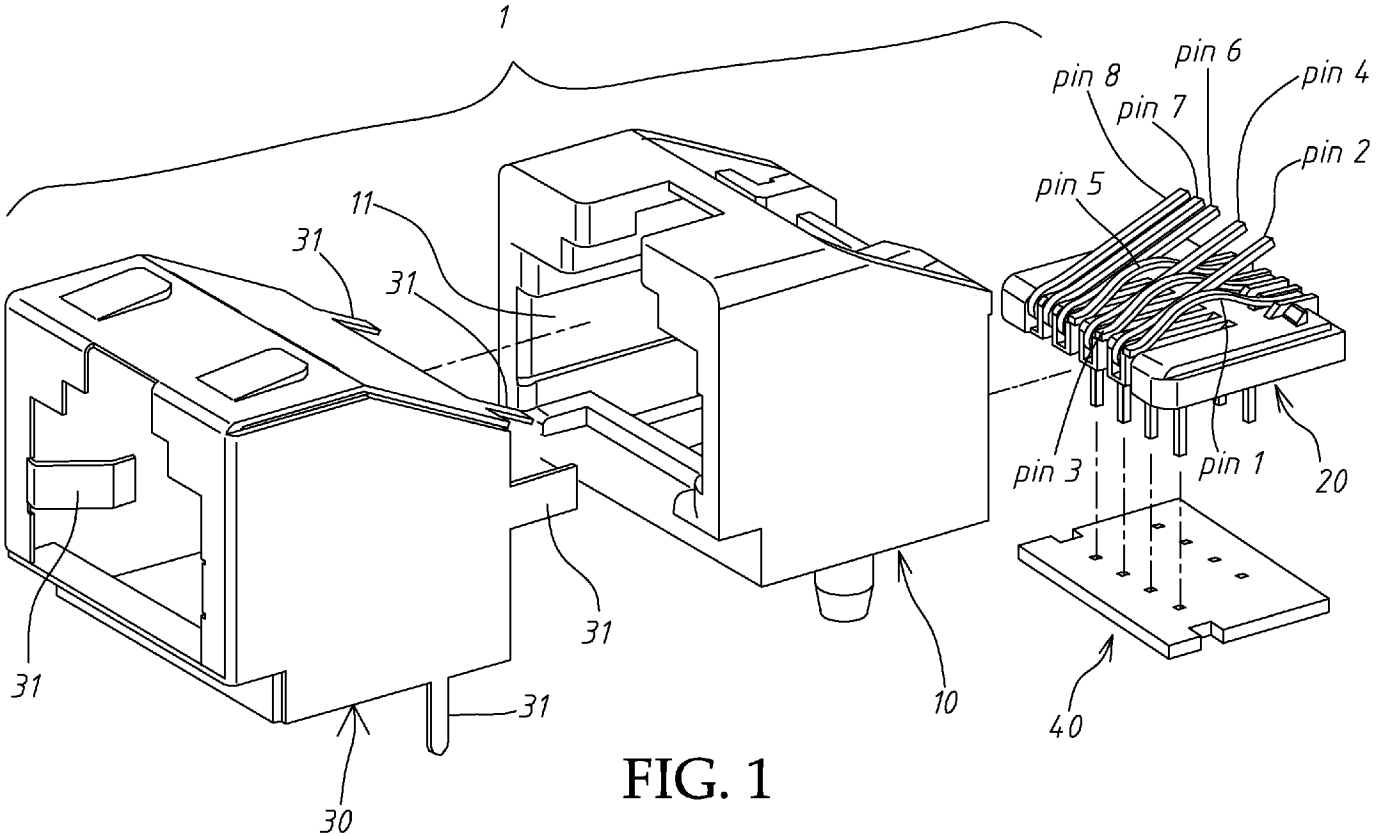
FIG. 1 is an exploded view of a female electrical connector in accordance with the present invention.
Figure 2:
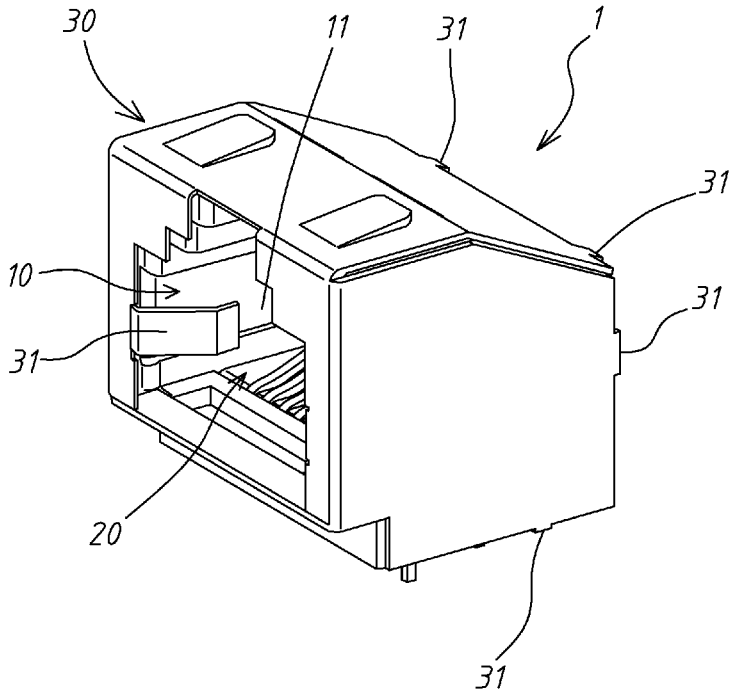
FIG. 2 is an elevational assembly view of the female electrical connector in accordance with the present invention.
Figure 3:
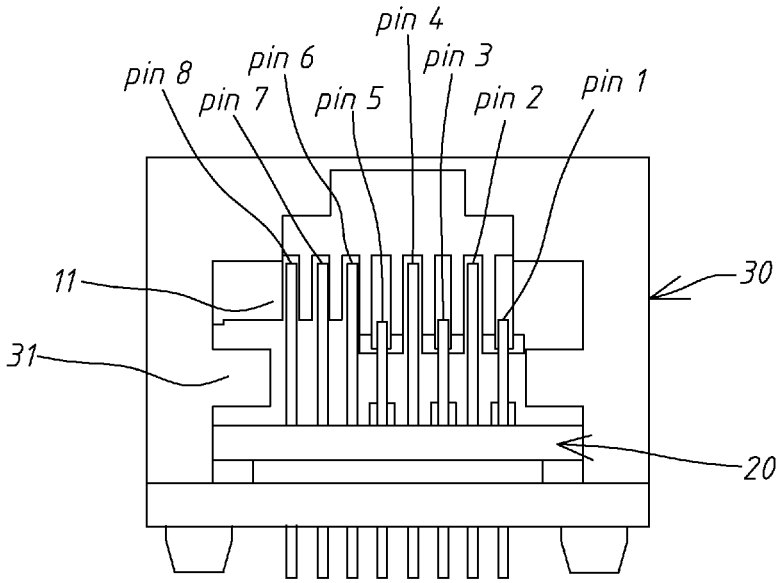
FIG. 3 is a front view of the female electrical connector in accordance with the present invention.

Referring to FIGS. 1-3, the invention provides a female electrical connector 1, for example, RJ 45 jack, for use with a matting male electrical connector (not shown) for network signal transmission. The female electrical connector 1 comprises an insulative housing 10, a rack 20, 8 pcs of gold pins $p^1$~$p^8$, a metal shielding shell 30 and a circuit board 40.

The insulative housing 10 comprises a front opening 11 for the insertion of a matting male electric connector. The metal shielding shell 30 surrounds the insulative housing 10 to give shielding protection, having a plurality of protruding clamping lugs 31 extended from the border thereof. After insertion of the insulative housing 10 into the metal shielding shell 30, the protruding clamping lugs 31 are respectively bent inwards and clamped on the outside wall of the insulative housing 10 to secure the insulative housing 10 in place, as shown in FIG. 2.

Figure 4:
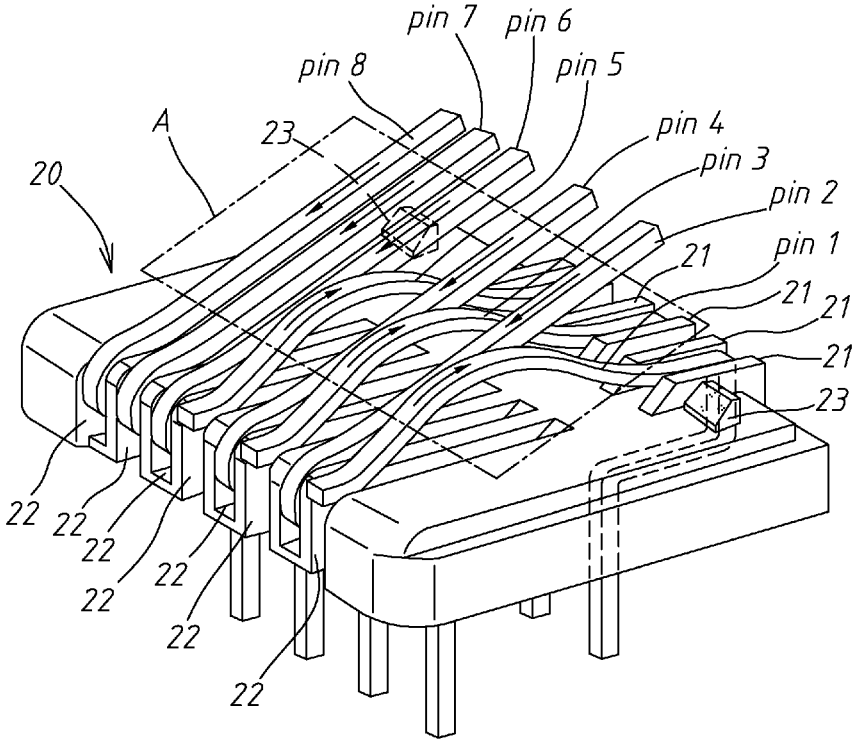
FIG. 4 is an enlarged view of a part of the present invention, illustrating the arrangement of the gold pins in the rack.
Figure 4A:
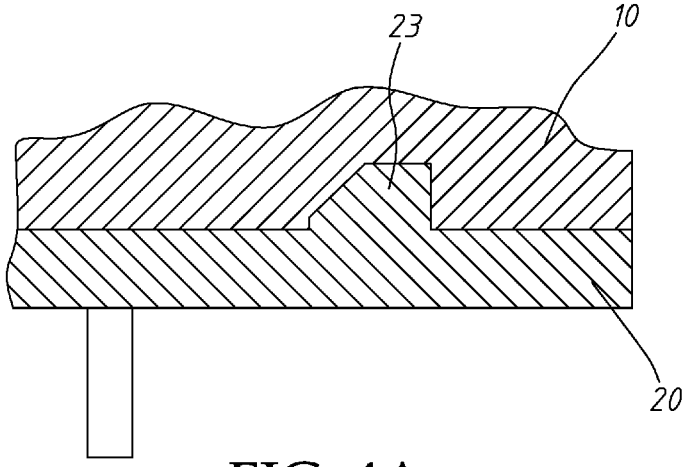
FIG. 4A is a sectional view, in an enlarged scale, of a part of the present invention, illustrating the top engagement blocks of the rack engaged with the inside wall of the insulative housing.
Figure 5:
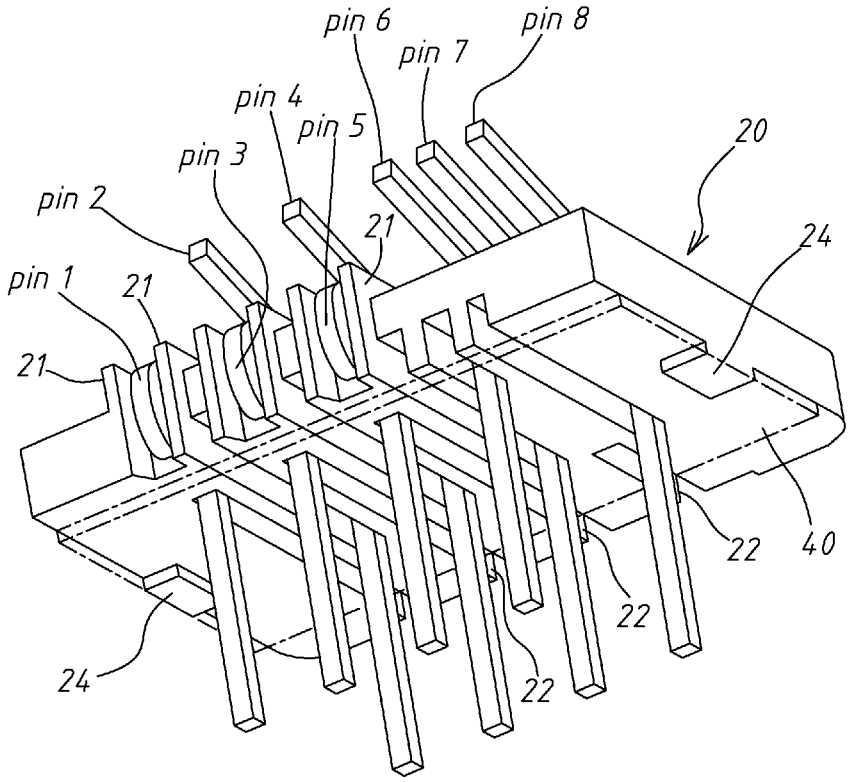
FIG. 5 corresponds to FIG. 4 when viewed from another angle.
Figure 6:
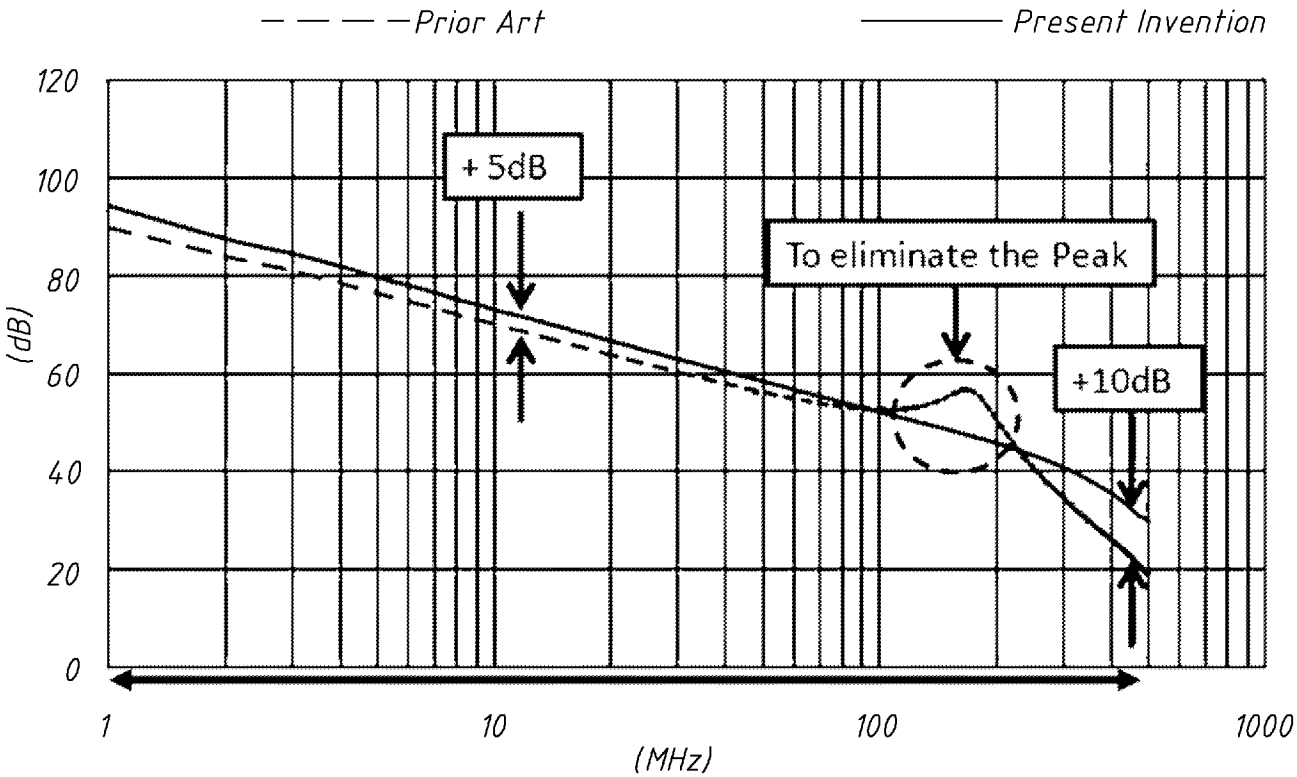
FIG. 6 is a crosstalk curve comparison chart, illustrating a crosstalk curve obtained from the female electrical connector of the present invention and a crosstalk curve obtained from the prior art design.

The rack 20 is mounted in the bottom side inside the insulative housing 10. Basically, the rack 20 is flat panel, as shown in FIGS. 4 and 5, having a plurality of stop blocks 21 located on the rear side thereof and spaced from one another for keeping the gold pins apart, a plurality of locating grooves 22 located on the front side thereof to prohibit every one of the gold pins $p^1$~$p^8$ from lateral displacement, two top engagement blocks 23 protruded from the top wall and respectively disposed near the two opposite lateral sides thereof, as shown in FIG. 4A, for engagement with the inside wall of the insulative housing 10, and two bottom locating blocks 24 for engagement with the circuit board 40, as shown in FIG. 5.

The gold pins $p^1$~$p^8$ are arranged on the rack 20 and numbered in a proper order from the first to the eighth, each having a top end suspending above the top wall of the rack 20 and a bottom end vertically downwardly extending out of the bottom wall of the rack 20 and electrically connected to the circuit board 40.

The main feature of the design of the present invention is characterized in that the top ends of the $2^{nd}$, $4^{th}$, $6^{th}$, $7^{th}$ and $8^{th}$ pins extend obliquely backwardly from the front side of the rack 20 and suspend above the rear side of the rack 20; the top ends of the $1^{st}$, $3^{rd}$ and $5^{th}$ pins extend obliquely backwardly from the front side of the rack 20 and are then curved and closely attached to the rear side of the rack 20. Thus, the transmission direction of the $1^{st}$, $3^{rd}$ and $5^{th}$ pins is reversed to that of the $2^{nd}$, $4^{th}$, $6^{th}$, $7^{th}$ and $8^{th}$ pins, as indicated by the arrowhead sign in FIG. 4. Further, the $1^{st}$, $3^{rd}$ and $5^{th}$ pins are respectively positioned in the locating grooves 22 of the rack 20, and the arched middle part of each of the $1^{st}$, $3^{rd}$ and $5^{th}$ pins protrudes over the elevation of the middle part of each of the $2^{nd}$, $4^{th}$, $6^{th}$, $7^{th}$ and $8^{th}$ pins that suspends above the rack 20, thereby constituting a plug contact area A, as indicated by the imaginary frame shown in FIG. 4.

Referring to FIG. 7, when compared to a conventional female electrical connector, the transmission direction of the $1^{st}$ pin of the female electrical connector 1 is same as the $3^{rd}$ and $5^{th}$ pins, and can reduce crosstalk interference, smoothening signal transmission in the full bandwidth range of 1~500 MHz. Further, the whole structural design is simple, facilitating fabrication and installation.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A female electrical connector for use with a male electrical connector for network signal transmission, comprising:

an insulative housing having a front opening for the insertion of a matting male electrical connector;

a rack flat configured and mounted in a bottom side inside said insulative housing, said rack having opposing front and rear sides and opposing top and bottom sides; and 8 pcs of gold pins numbered from $1^{st}$ to $8^{th}$ and respectively arranged on said rack, each said gold pin having a top end extending to the top side of said rack and a bottom end vertically downwardly extending out of the bottom side of said rack;

wherein the top ends of said $2^{nd}$, $4^{th}$, $6^{th}$, $7^{th}$ and $8^{th}$ pins extend obliquely backwardly from the front side of said rack and suspend above the rear side of said rack; the top ends of said $1^{st}$, $3^{rd}$ and $5^{th}$ pins extend obliquely backwardly from the front side of said rack and are then curved and closely attached to the rear side of said rack so that the transmission direction of said $1^{st}$, $3^{rd}$ and $5^{th}$ pins is reversed to that of said $2^{nd}$, $4^{th}$, $6^{th}$, $7^{th}$ and $8^{th}$ pins; said $1^{st}$, $3^{rd}$ and $5^{th}$ pins each have an arched middle part protruding over the elevation of a middle part of the top end of each of said $2^{nd}$, $4^{th}$, $6^{th}$, $7^{th}$ and $8^{th}$ pins that suspends above said rack, thereby constituting a plug contact area.

2. The female electrical connector as claimed in claim 1, further comprising a metal shielding shell surrounding said insulative housing.

3. The female electrical connector as claimed in claim 1, wherein said rack comprises a plurality of stop blocks located on the rear side thereof and adapted for separating said $1^{st}$, $3^{rd}$ and $5^{th}$ pins.

4. The female electrical connector as claimed in claim 2, wherein said rack comprises a plurality of grooves located on the front side thereof and adapted for prohibiting each said pin from lateral displacement.

5. The female electrical connector as claimed in claim 2, wherein said rack comprises two top engagement blocks bilaterally protruded from the top side thereof for engagement with said insulative housing.

6. The female electrical connector as claimed in claim 2, wherein said rack comprises two bottom locating blocks for fastening to a circuit board.

7. The female electrical connector as claimed in claim 2, wherein said metal shielding shell comprises a plurality of protruding clamping lugs extended from the border thereof for fastening to said insulative housing.

* * * * *